US006276929B1

(12) United States Patent
Kuroda et al.

(10) Patent No.: US 6,276,929 B1
(45) Date of Patent: Aug. 21, 2001

(54) METHOD FOR CONTROLLING KILN PRESSURE

(75) Inventors: Tsuyoshi Kuroda, Kuwana; Kenji Kawaguchi; Yasuhiro Ito, both of Nagoya, all of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/145,644

(22) Filed: Sep. 2, 1998

(30) Foreign Application Priority Data

Sep. 3, 1997 (JP) ..... 9-238401

(51) Int. Cl.[7] ..... F27D 19/00

(52) U.S. Cl. ..... 432/47; 432/24; 432/37; 110/162; 110/163; 431/19; 431/20

(58) Field of Search ..... 432/24, 72, 19, 432/37, 39, 47, 57; 110/162, 163; 431/19, 20

(56) References Cited

U.S. PATENT DOCUMENTS 5,257,574 * 11/1993 Hiromichi ..... 431/19

FOREIGN PATENT DOCUMENTS 56-162320 12/1981 (JP) .
59-177329 * 10/1984 (JP) .
63-118520 5/1988 (JP) .
63-134245 9/1988 (JP) .
7-280256 * 10/1995 (JP) .

* cited by examiner

*Primary Examiner*—Jiping Lu
(74) *Attorney, Agent, or Firm*—Parkhurst & Wendel, LLP

(57) ABSTRACT

A method for controlling kiln pressure for a shuttle kiln having an exhaust gas fan and an exhaust gas damper in an exhaust gas passage includes the steps of performing a control operation for controlling the number of revolution of the exhaust gas fan to control flow rate of the exhaust gas to maintain the kiln pressure at a predetermined pressure, and performing a control operation for adjusting opening of the exhaust gas damper based on the number of revolution of the exhaust gas fan. The method can expand the control range of exhaust gas flow, and operation with energy saving efficiency can be performed.

6 Claims, 4 Drawing Sheets

METHOD FOR CONTROLLING KILN PRESSURE

BACKGROUND OF THE INVENTION AND RELATED ART STATEMENT

The present invention relates to a method for controlling furnace pressure of a shuttle kiln, and, more particularly, to an improvement of method for controlling pressure in a shuttle kiln to a target value by controlling the number of revolutions of an exhaust gas fan to adjust an exhaust gas flow rate of combustion a exhaust gas or the like.

To maintain a combustion state in a shuttle kiln at the most desirable state, it is one of requirement to control a kiln pressure to within a certain range. The kiln pressure is obtained by providing suitable resistance in exhausting combustion air or fuel supplied into the kiln from burners of the shuttle kiln or other feed air such as cooling air in order to cause a pressure difference between inside and outside of the kiln.

In a shuttle kiln, particularly, since a series of heating operations such as raising of temperature, soaking of the maximum temperature or cooling are performed, supply operations significantly vary for combustion air or cooling air as time passes, so that control of kiln pressure is one of automatic control factors essential to the operation of shuttle kiln.

Herein, is described an example of conventional method for controlling kiln pressure of a shuttle kiln with reference to FIG. 4. In the kiln body 11 of the shuttle kiln, fuel, combustion air or the like fed from outside become exhaust gas after combustion, the exhaust gas being discharged to an exhaust flue 12, fed to a chimney 15 from an exhaust gas damper 3 through a plenum 13, into which outside air is introduced, as required, by an exhaust gas fan 14, and finally discharged into the air.

In this case, to also control the kiln pressure in the kiln body 11, there is formed a PID control loop which uses the kiln pressure as an input element and the number of revolution of the exhaust gas fan 14 as an output element. Referring to FIG. 4, the kiln pressure in the kiln body 11 is sent by the pressure transmitter 21 to a control arithmetic unit 22, which in turn instructs an inverter controller 23 driving the exhaust gas fan 14 to issue a variable speed drive output so that the exhaust gas fan 14 rotates at a number of revolution depending on a deviation from a target value.

Thus, the kiln pressure can be stably maintained by automatically adjusting flow rate of the exhaust gas in such manner that the number of revolution of the exhaust gas fan 14 is decreased under control of the variable speed drive to raise the kiln pressure, and increased to reduce the kiln pressure.

In addition, the flow rate of exhaust gas may be controlled by adjusting opening of the exhaust gas damper 3 with an exhaust gas damper program 31 which is programmed according to elapsed time. However, in operation of an actual kiln, it is unavoidable that offset from the program is caused by disturbance such as a shape of a product, changes in dimensions, pack weight, or variation of outside air temperature. Accommodation to such situation requires corrective operation by an operator, or safety measures to maintain the number of revolution at a value higher than necessary, which causes disadvantages in promotion of automation or energy saving measures.

On the other hand, when the number of revolution of the variable speed drive is controlled for the exhaust gas fan 14, there are disadvantages that, in a range between 1/10 and 1/20 or lower of the rated number of revolution, a motor for driving the fan would have insufficient continuous allowable torque, and could not handle load torque, leading to unstable rotation, and thus difficulty in control, and that cooling air flow becomes insufficient due to insufficient number of revolutions causing insufficient cooling in the motor. Thus, the control range for the number of revolutions of the exhaust gas fan would be values in a range between 1:10 to 1:20 in terms of the rated number of revolution, leading to a problem that the flow rate of exhaust gas can be controlled only for values in a range between 1:10 and 1:20 corresponding to the control range.

SUMMARY OF THE INVENTION

As described, in the kiln pressure control exemplified in FIG. 4, the lower limit of control for the number of revolutions of the exhaust gas fan is 1/10 to 1/20 of the rated number of revolution, and has a control range of 1:10 to 1:20, and this causes no particular trouble in the conventional shuttle kiln because its control range for an exhaust gas flow rate is about 1:20. However, a control range as wide as 1:30 to 1:50 of the exhaust gas flow rate is demanded for a recent energy saving combustion system intended for reducing excess air in the low temperature range represented by pulse firing or the like.

The present invention has been made to satisfy such new requirements, and provides a method for controlling kiln pressure for a shuttle kiln, the kiln comprising an exhaust gas fan and an exhaust gas damper, both of which are conventional, which can expand a control range, and enables it to enhance an energy saving effect.

To solve the above problems, the method for controlling kiln pressure for a shuttle kiln according to the present invention comprises an exhaust gas fan and an exhaust gas damper in an exhaust gas passage, the method comprising the steps of performing a control operation for controlling the number of revolutions of the exhaust gas fan to control the flow rate of the exhaust gas to hold the kiln pressure at a predetermined pressure, and performing a control operation for adjusting opening of the exhaust gas damper based on the number of revolutions of the exhaust gas fan.

In addition, the present invention can be embodied in a form in which opening of the exhaust gas damper is controlled to a closing direction when the number of revolutions of the exhaust gas fan lowers less than a predetermined set value, and to an opening direction when it recovers to the set value or more. Then, it is particularly preferable to set the predetermined set value of the number of revolutions to 1/5 to 1/10 of the rated number of revolution.

Furthermore, it is preferable to prepare a control method for stopping the control of opening of the exhaust gas damper based on the number of revolution of the exhaust gas fan, and automatically or manually operating the opening to an opening separately and arbitrarily set, and to allow it to freely change over to this method.

DETAILED DESCRIPTION OF PREFERRED EMBODIMENT

Figure 1:
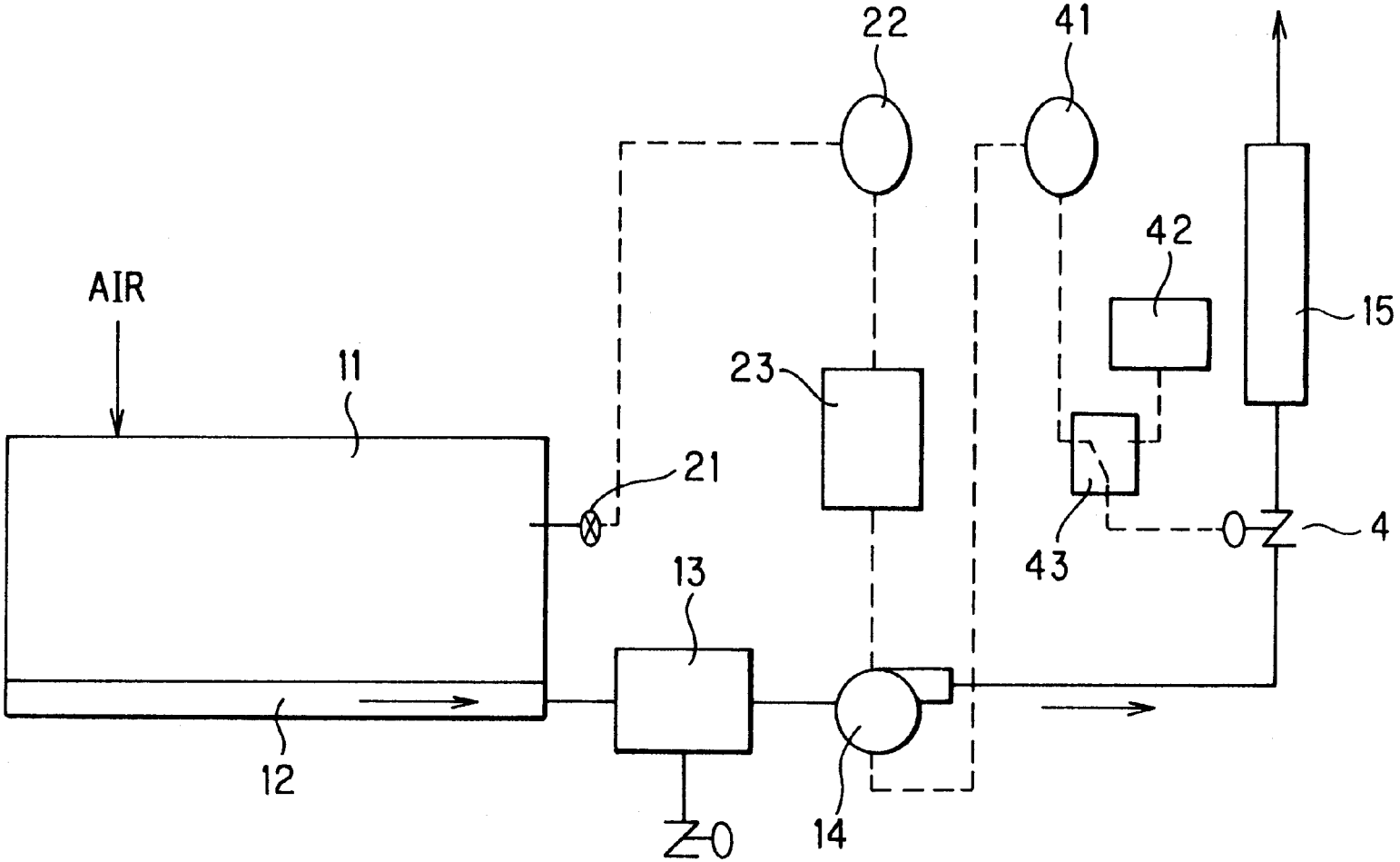
FIG. 1 is a conceptual diagram of a shuttle kiln for illustrating a method for controlling kiln pressure according to the present invention.
Figure 2:
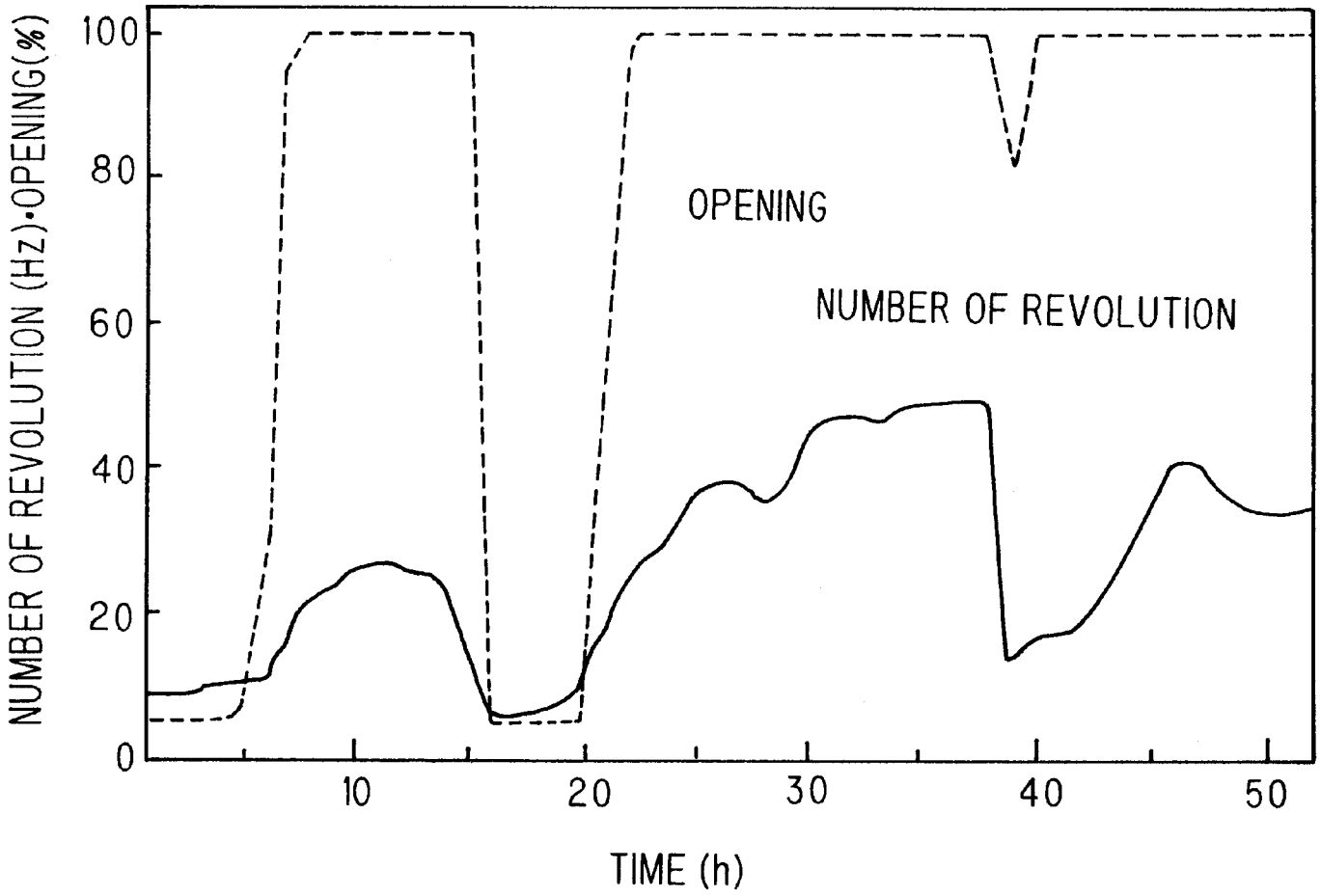
FIG. 2 is an actual state of time-number of revolution or the like according to the kiln pressure control method according to the present invention.
Figure 3:
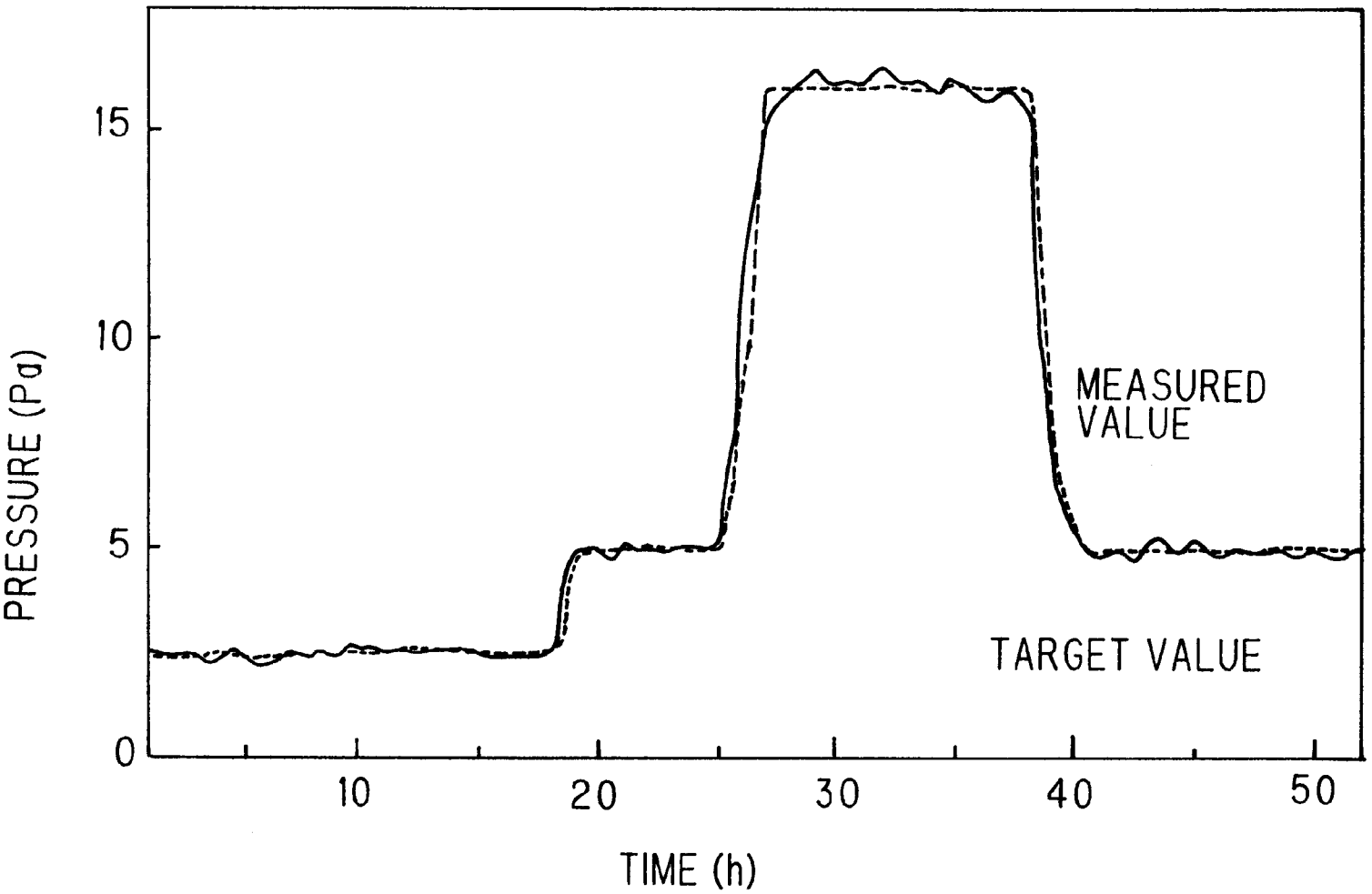
FIG. 3 is an actual state of time-kiln pressure or the like according to the kiln pressure control method according to the present invention.
Figure 4:
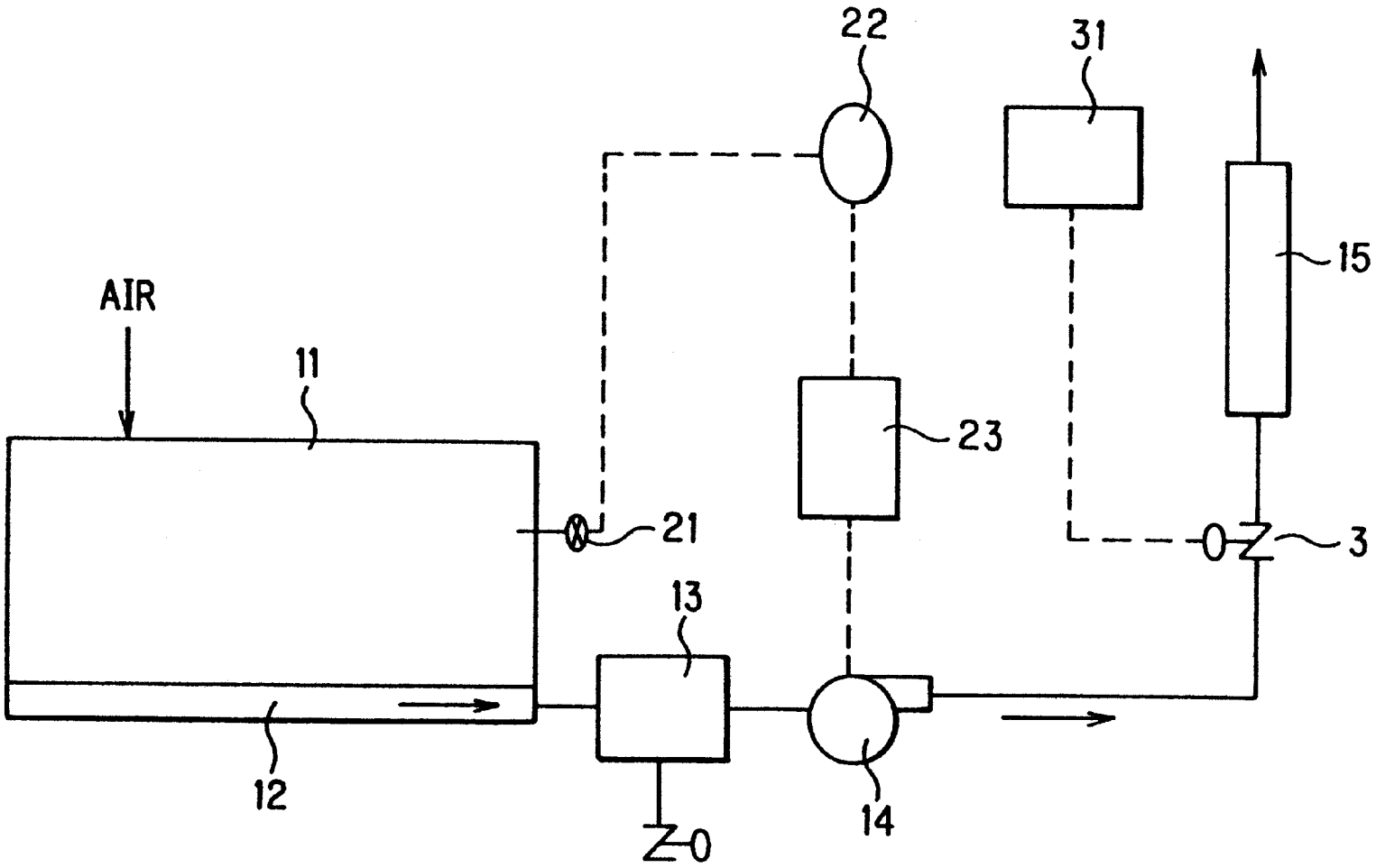
FIG. 4 PRIOR ART
FIG. 4 is a conceptual diagram of a shuttle kiln for illustrating a conventional method for controlling kiln pressure.

Now, there is described an embodiment of the kiln pressure control method for a shuttle kiln according to the present invention with reference to FIGS. 1–3.

The kiln pressure control method for a shuttle kiln according to the present invention, in FIG. 1, is applied to a combustion kiln such as a shuttle kiln in which exhaust gas is discharged from an exhaust gas flue 12 of a furnace body 11, successively fed to an exhaust gas fan 14, an exhaust gas damper 4, and a chimney 15 through a plenum 13, and finally exhausted into air. It is also similar to the one described above in that there is formed a PID control loop which uses the kiln pressure as an input element and the number of revolution of the exhaust gas fan 14 as an output element in order to control the kiln pressure in the kiln body 11.

Specifically, as exemplified in FIG. 1, a pressure transmitter 21 sends a signal on kiln pressure in the kiln body 11 to a control arithmetic unit 22, which in turn instructs a variable speed drive 23 driving the exhaust gas fan 14 to issue a variable speed drive output so that the exhaust gas fan 14 rotates at a number of revolutions depending on a deviation from a target value. The kiln pressure can be stably maintained by automatically adjusting flow rate of the exhaust gas.

Then, the present invention is characterized by the above mentioned method for controlling kiln pressure for a shuttle kiln comprising an exhaust gas fan 14 and an exhaust gas damper 4 in an exhaust gas passage, the method comprising the steps of performing a control operation for controlling the number of revolutions of the exhaust gas fan 14 to control flow rate of the exhaust gas to hold the kiln pressure at a predetermined pressure, and performing a PID control operation for adjusting opening of the exhaust gas damper 4 based on the number of revolution of the exhaust gas fan 14.

The PID opening control for the exhaust gas damper 4 is specifically, in FIG. 1, to send a signal of the number of revolution of the exhaust gas fan 14 to an exhaust gas damper controller 41, based on which the signal of the number of revolution a PID signal adjusting the opening of the exhaust gas damper 4 is sent to the exhaust gas damper 4, wherein the damper is opened or closed to an opening direction in a higher number of revolution region, and to a closing direction in a lower number of revolution region.

In this case, the present invention can be embodied in a form to cope with a low flow rate of the exhaust gas by controlling the opening of the exhaust gas damper 4 to the closing direction when the number of revolution of the exhaust gas fan 14 lowers less than the predetermined set value, and cope with a high flow rate of the exhaust gas by controlling the opening of the exhaust gas damper 4 to the opening direction when the number of revolution recovers to the set value or more, thereby preventing the number of revolution from being lower than the lower control limit. Then, the predetermined set value of the number of revolutions may be sufficient to be that near the lower control limit for the number of revolutions of the exhaust gas fan 14 being used, and, specifically, may be preferably 1/5 to 1/10 of the rated number of revolution.

Since the present invention performs such control for opening of the exhaust gas damper, when, in the normal operation mode where the opening of damper is 100%, there arises a situation where the fan is required to rotate at the number of revolution at a value lower than the set value selected from a range near the lower control limit, if the damper is operated to the closing direction by the damper opening control, so that the opening is closed from 100% to 10%, then control is performed to reduce the flow rate of exhaust gas to a low rate of 1/10 at the moment to raise the furnace pressure, and thus, thereby recovering the number of revolutions of the fan. Thus, it becomes possible for the number of revolutions of the fan to be prevented from lowering the lower control limit. In addition, since the flow rate is further adjusted in such state where the flow rate of exhaust gas is reduced, there can be provided an advantage that a wide control range can be obtained from 100% of the maximum flow rate to 1% of the minimum flow rate.

In a case where the control range does not need to be expanded to a level lower than the lower control limit for the fan, there is provided such advantage allowing effective energy saving operation that the damper is fully opened to 100% to minimize the exhaust resistance by the damper, thereby effectively utilizing natural ventilation to obtain ideal flow rate.

FIGS. 2 and 3 exemplify the results of implementation of the control method according to the present invention described above.

FIG. 2 shows a relationship between elapsed time from heating to cooling of a shuttle kiln, and the number of revolutions of fan when the number of revolutions of the fan for damper opening control is set to 10 Hz. According to this result, for example, in an interval from the 15th hour to the 21st hour when the number of revolution is set to a low value, the damper opening is adjusted to 5%, and the number of revolutions of the fan does not become lower than about 6 Hz which is the lower control limit. In addition, when it is compared with FIG. 3 showing the relationship between expiration of time and kiln pressure, the target value of kiln pressure significantly varies in an interval from the 15th hour to the 21st hour, while the measured kiln pressure is well controlled to follow the target value.

In addition, the present invention is preferable to stop the control of the opening of the exhaust gas damper based on the number of revolutions of the exhaust gas fan 14, and to freely change over to a control operation for adjusting the opening of the exhaust gas damper to an opening separately and arbitrarily set by the independent damper opening output. For example, in FIG. 1, if the operation circuit of the exhaust gas damper is provided with a changeover box 43 to allow it to change over to either the exhaust gas damper controller 41 as described or a preset damper output device 42, it is possible to operate the damper to an arbitrarily set opening under an instruction from the preset damper output device 42, as required.

Providing such a subsystem enables it to disconnect the damper operation output from the automatic control based on the number of revolutions of the fan in transferring to the cooling process in the latter half stage of the heating process, or in an abrupt change of load when purge completes in the kiln, and to independently control it, so that response can be assured in the kiln pressure control.

An example is shown in FIGS. 2 and 3, in which the process is changed over to the cooling process around the 38th hour on the axis of abscissa. In this case, since the control for number of revolution of fan can be supported by changing over the damper opening from 100% to 80% set by the preset damper output device for a predetermined period of time, it is possible to prevent excessive reduction of kiln pressure although the target value is abruptly reduced.

Since the kiln pressure control method for a shuttle kiln according to the present invention is arranged as described above, it becomes possible to expand the control range of the exhaust gas flow in which the kiln pressure can be stably controlled to a level of 1:100 from conventional about 1:10, thereby operation with high energy saving efficiency can be performed. Thus, the present invention has extremely high industrial value as a kiln pressure control method for a shuttle kiln which eliminates the conventional problems.

What is claimed is:

1. A method for controlling kiln pressure for a shuttle kiln comprising an exhaust gas fan and an exhaust gas damper in an exhaust gas passage, said method comprising:

performing a control operation for controlling a number of revolutions of the exhaust gas fan to control flow rate of an exhaust gas to maintain an internal kiln pressure at a predetermined pressure and, performing a control operation for adjusting opening of the exhaust gas damper based on the number of revolutions of said exhaust gas fan, said exhaust gas damper control operation being carried out through a changeover box connected to both a controller operating based on the number of revolutions of the exhaust gas fan and a preset damper output device.

2. The method for controlling kiln pressure for a shuttle kiln as set forth in claim 1, wherein opening of said exhaust gas damper is controlled to a closing direction when the number of revolution of said exhaust gas fan lowers less than a predetermined set value, and to an opening direction when said exhaust gas fan recovers to the set value or more.

3. The method for controlling kiln pressure for a shuttle kiln as set forth in claim 2, wherein said predetermined set value of the number of revolution is set to 1/5 to 1/10 of a rated number of revolution.

4. The method for controlling kiln pressure for a shuttle kiln as set forth in claim 3, wherein said method is switched to a control method for stopping the control of opening of the exhaust gas damper based on the number of revolutions of the exhaust gas fan, and operating the opening of the exhaust gas damper to an opening separately and arbitrarily set.

5. The method for controlling kiln pressure for a shuttle kiln as set forth in claim 1, wherein said method is switched to a control method for stopping the control of opening of the exhaust gas damper based on the number of revolutions of the exhaust gas fan, and operating the opening of the exhaust gas damper to an opening separately and arbitrarily set.

6. The method for controlling kiln pressure for a shuttle kiln as set forth in claim 2, wherein said method is switched to a control method for stopping the control of opening of the exhaust gas damper based on the number of revolutions of the exhaust gas fan, and operating the opening of the exhaust gas damper to an opening separately and arbitrarily set.

* * * * *